United States Patent [19]

Birch

[11] 4,201,380

[45] May 6, 1980

[54] PORTABLE DISASSEMBLABLE STAND FOR WEIGHT LIFTING EQUIPMENT

[76] Inventor: Arthur D. Birch, 45 Hillcrest Rd., Warren, N.J. 07060

[21] Appl. No.: 887,017

[22] Filed: Mar. 16, 1978

[51] Int. Cl.[2] ..... A63B 21/06; A63B 13/00

[52] U.S. Cl. ..... 272/117; 211/60 R; 211/85; 248/188.1; 248/165

[58] Field of Search ..... 272/101, 123, 122, 144, 272/145, 118, 117, 136, 62, 63, 64, 135; 211/68, 85, 60 R, 64, 67; 248/165, 127, 188.1, 346

[56] References Cited

U.S. PATENT DOCUMENTS

| | | | |
|---|---|---|---|
| 775,718 | 11/1904 | Bitter | 272/63 |
| 1,982,934 | 12/1934 | Squire | 272/102 |
| 2,827,116 | 3/1958 | Zaloucik | 272/103 X |
| 3,082,878 | 3/1963 | Thomas | 211/60 R |
| 3,107,091 | 10/1963 | Jenkins | 272/103 |
| 3,118,668 | 1/1964 | Calcahan | 272/123 X |
| 3,288,304 | 11/1966 | Graves | 211/64 |
| 4,046,373 | 9/1977 | Kim | 272/144 |

*Primary Examiner*—William R. Browne
*Attorney, Agent, or Firm*—Howard I. Podell

[57] ABSTRACT

A portable, quickly disassembled stand for barbells comprising a base formed of a cross piece adapted to rest on a floor and having slots near each end; a pair of first rectangular members having a flat under surface part of which lies on the same plane as that of the cross bar and has a notched recessed front part fitting over the ends of the cross bar on one side of the bar. A pair of aligned superimposed dowel-receiving openings in the notches of the members receive each a dowel projecting from a second pair of stabilizing members fitting partly over the cross piece. A pair of upright barbell supports fit in the notches and are secured by dowels. Lateral struts are hinged to the supports.

4 Claims, 2 Drawing Figures

PORTABLE DISASSEMBLABLE STAND FOR WEIGHT LIFTING EQUIPMENT

FIELD OF THE INVENTION

This invention relates generally to a barbell support.

The principal object of this invention is to provide a device or article of this character which combines simplicity, strength and durability in a high degree, together with inexpensiveness of construction so as to encourage widespread use thereof.

Other objects of this invention will in part be obvious and in part hereinafter pointed out.

The invention accordingly consists in the features of construction, combinations of elements, and arrangement of parts which will be exemplified in the construction hereinafter described, and of which the scope of application will be indicated in the following claims.

SUMMARY OF THE INVENTION

This invention resides in a portable, quickly disassembled stand for barbells comprising a base formed of a cross piece adapted to rest on a floor and having slots near each end; a pair of first rectangular members having a flat under surface part of which lies on the same plane as that of the cross bar and has a notched recessed front part fitting over the ends of the cross bar on one side of the bar. A pair of aligned superimposed dowel-receiving openings in the notches of the members receive each a dowel projecting from a second pair of stabilizing members fitting partly over the cross piece. A pair of upright barbell supports fit in the notches and are secured by dowels. Lateral struts are hinged to the supports.

BRIEF DESCRIPTION OF THE DRAWING

In the accompanying drawing, in which is shown one of the various possible illustrative embodiments of this invention, wherein like reference character identify the same or like parts.

DESCRIPTION OF THE PREFERRED EMBODIMENTS

Figure 2:
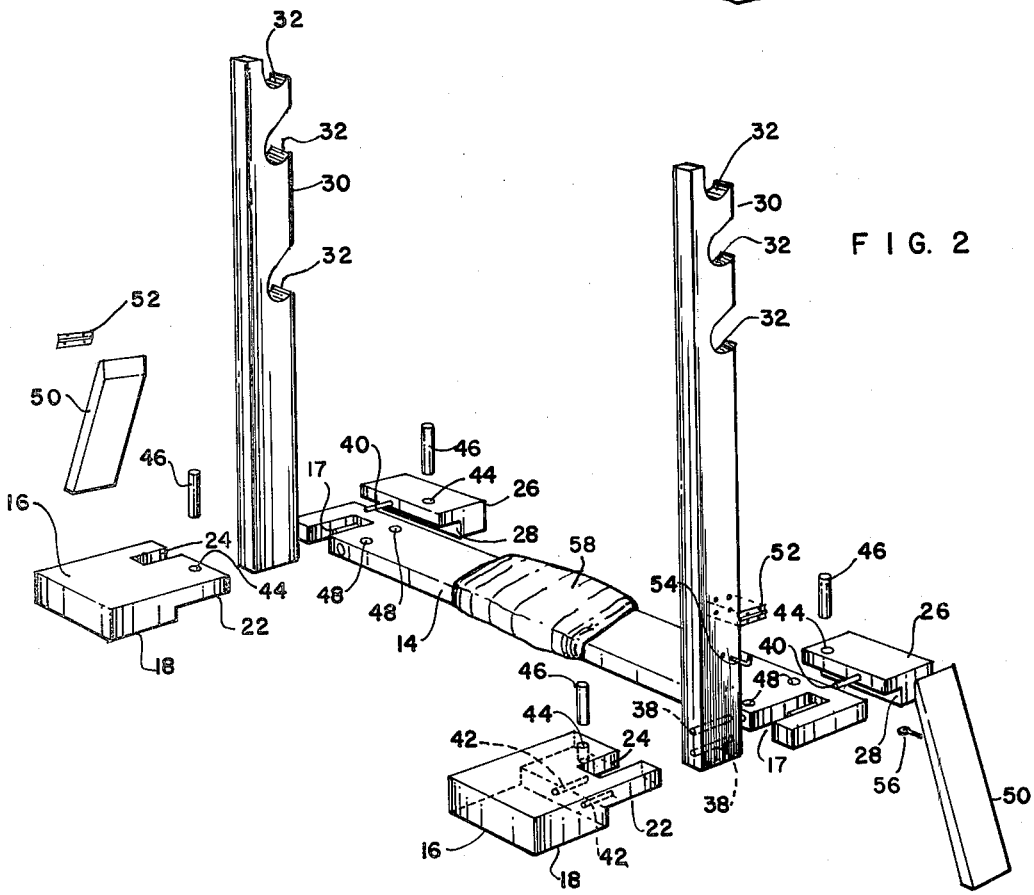
FIG. 2 is an exploded view thereof.

With reference to the drawing, there is shown and illustrated a barbell stand constructed in accordance with the principles of the invention and designated generally by reference character 10. The illustrated tangible embodiment of the invention includes a base 12 composed of flat cross bar or piece 14 which can be made of wood or plastic or other suitable material. Transverse notches 17 are provided near each end of member 14. A pair of rectangular members 18 having a front part 16 is adapted to rest on floor 20. The rear part of members 18 is recessed at 22 to fit over the top of cross piece 14. Members 18 each have a notch 24 (FIG. 2) adapted to register over the notches 17 of cross piece 14.

A pair of complementary blocks 26 are placed on the opposite side of cross piece 14 and also have a recessed front part 28 adapted to fit over the cross piece 14.

Figure 1:
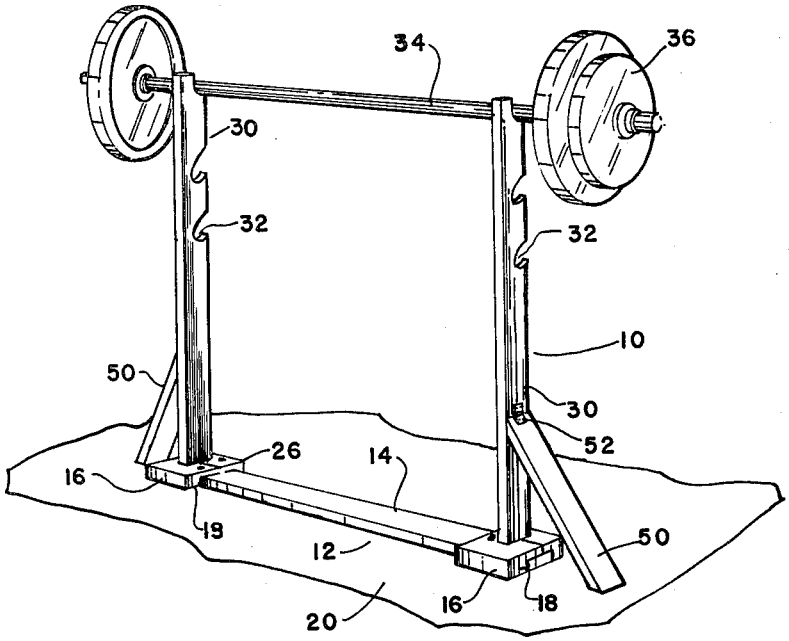
FIG. 1 is a perspective view showing the stand of the invention assembled.

Frame 12 supports uprights 30 which have spaced arcuate notches 32 therein for holding the bar 34 of a barbell such as 36. The lower end of each upright has a pair of aligned superposed bores 38 drilled therein. The upper bore receives therein fixed dowel 40 projecting from the front surface of blocks 26, and which continues into complementary holes 42 in members 18 as members 18 and blocks 26 abut in assembled position as shown in FIG. 1. Vertical openings 44 are provided in both pairs of blocks for four removable dowels 46 which penetrate into registering vertical openings 48.

It is noteworthy to remark that all the parts forming the stand 10 are joined together by the four dowels 46 which in fact makes the stand readily assemblable and disassemblable. When apart, the parts readily fit under the bed or in a closet.

For better stability, a pair of lateral struts 50 are hinged by hinges 52 to the outside of uprights 30. Hooks 54 on the uprights receive loops 56 on the inside surfaces of struts 50, to adjust the spacing therebetween.

A padded head rest 58 can be secured on cross piece 14 for the added comfort of the weight lifter.

The operation and use of the invention hereinabove described will be evident to those skilled in the art to which it relates from a consideration of the foregoing.

It will thus be seen that there is provided a device in which the several objects of this invention are achieved, and which is well adapted to meet the conditions. Its advantages are easily understood.

It is thought that persons skilled in the art to which this invention relates will be able to obtain a clear understanding of the invention after considering the foregoing description in connection with the accompanying drawing. Therefore, a more lengthy description is deemed unnecessary.

It is to be understood that various changes in shape, size and arrangement of the elements of this invention as claimed may be resorted to in actual practice, if desired.

Having thus described the invention, what is claimed as new and to be secured by Letters Patent is:

1. A barbell stand comprising a base formed of a cross piece adapted to rest flat on a surface, said piece having notches near the ends thereof; a pair of blocks on each side of said cross piece; one block of each pair having a notch adapted to register with the underlying notch of said piece; each block having a portion fitting over said piece with the ends of said portions abutting; uprights fitting in said notches, securing means fixed to one of said blocks and passing through an opening in one of said uprights and received in the other and opposite block of the same pair; vertical removable securing means fitting in registering openings in said blocks and said cross piece, said uprights having alinged notches for holding a bar of a barbell.

2. The barbell stand as recited in claim 1, further including struts hinged to the outside of said uprights.

3. The barbell stand as recited in claim 1, further including a padded head rest on said cross piece intermediate said uprights.

4. The barbell stand as recited in claim 1, wherein said securing means consist of dowels.

* * * * *